US009254415B2

(12) United States Patent
Ha

(10) Patent No.: US 9,254,415 B2
(45) Date of Patent: Feb. 9, 2016

(54) STRETCHING DEVICE

(76) Inventor: Sung Eui Ha, Buchun-si (KR)

( * ) Notice: Subject to any disclaimer, the term of this patent is extended or adjusted under 35 U.S.C. 154(b) by 60 days.

(21) Appl. No.: 14/124,311

(22) PCT Filed: Jun. 5, 2012

(86) PCT No.: PCT/KR2012/004427

§ 371 (c)(1),
(2), (4) Date: Dec. 6, 2013

(87) PCT Pub. No.: WO2012/169762

PCT Pub. Date: Dec. 13, 2012

(65) Prior Publication Data

US 2014/0100087 A1 Apr. 10, 2014

(30) Foreign Application Priority Data

Jun. 7, 2011 (KR) ..... 10-2011-0054574

(51) Int. Cl.
*A63B 23/08* (2006.01)
*A63B 23/10* (2006.01)
(Continued)

(52) U.S. Cl.
CPC ..... *A63B 23/03508* (2013.01); *A61H 1/0244* (2013.01); *A61H 1/0266* (2013.01);
(Continued)

(58) Field of Classification Search
CPC ..... A61H 1/0266; A61H 1/0244; A61H 2203/0406; A61H 2201/1284; A61H 2201/164; A61H 2201/1635; A61H 2201/1671; A61H 2201/1269; A63B 21/00094; A63B 21/00098; A63B 21/00101; A63B 21/00123; A63B 21/00127; A63B 21/02; A63B 21/023; A63B 21/025; A63B 21/04; A63B 21/0407; A63B 21/0421; A63B 21/0435; A63B 21/0442; A63B 21/045; A63B 21/0455; A63B 21/05; A63B 21/1465; A63B 21/1469; A63B 21/1492; A63B 21/1496; A63B 22/14; A63B 22/16; A63B 22/18; A63B 2022/185; A63B 2023/003; A63B 2023/006; A63B 23/0216; A63B 23/0222; A63B 23/03508; A63B 23/03516; A63B 23/03525; A63B 23/08; A63B 23/085; A63B 2071/025; A63B 2208/0204
See application file for complete search history.

(56) References Cited

U.S. PATENT DOCUMENTS 1,975,382 A * 10/1934 Wrobley ..... 482/131
2,206,902 A * 7/1940 Kost ..... 601/27
(Continued)

FOREIGN PATENT DOCUMENTS

JP 3776109 5/2006
KR 2001996610000 8/2000
(Continued)

OTHER PUBLICATIONS

International Search Report—PCT/KR2012/004427 dated Dec. 17, 2012.

*Primary Examiner* — Oren Ginsberg
*Assistant Examiner* — Gary D Urbiel Goldner
(74) *Attorney, Agent, or Firm* — Cantor Colburn LLP

(57) ABSTRACT

Disclosed herein is a stretching device which makes it possible for a user to stretch muscles such as the calf muscles and Achilles tendons. The foothold unit (10) includes a base plate (12), and an inclined foothold (11) disposed above the base plate at a position spaced apart from the base plate. A support pole unit (30) is disposed in a central portion of the foothold unit. The support pole unit includes a lower tubular member (31) fixed to the base plate (12), an upper tubular member (32) disposed in the lower tubular member so as to be adjustable in height, with a handle (36) provided on an upper end of the upper tubular member, and a fastener (33) fastening the upper tubular member to the lower tubular member. The inclined foothold is provided so as to be rotatable with respect to the support pole unit.

5 Claims, 2 Drawing Sheets

(51) Int. Cl.

| | |
|---|---|
| ***A63B 22/14*** | (2006.01) |
| ***A63B 22/16*** | (2006.01) |
| ***A63B 23/035*** | (2006.01) |
| ***A61H 1/02*** | (2006.01) |
| *A63B 22/18* | (2006.01) |
| *A63B 21/02* | (2006.01) |
| *A63B 21/04* | (2006.01) |
| *A63B 23/00* | (2006.01) |
| *A63B 71/02* | (2006.01) |

(52) U.S. Cl.

CPC . *A61H2201/1269* (2013.01); *A61H 2201/1284* (2013.01); *A61H 2201/164* (2013.01); *A61H 2201/1635* (2013.01); *A61H 2201/1671* (2013.01); *A61H 2203/0406* (2013.01); *A63B 21/023* (2013.01); *A63B 21/0442* (2013.01); *A63B 22/14* (2013.01); *A63B 22/18* (2013.01); *A63B 23/08* (2013.01); *A63B 2023/006* (2013.01); *A63B 2071/025* (2013.01); *A63B 2208/0204* (2013.01)

(56) References Cited

U.S. PATENT DOCUMENTS

| | | | | | |
|---|---|---|---|---|---|
| 2,726,845 | A | * | 12/1955 | Hyslop, Jr. et al. | 254/131 |
| 3,065,962 | A | * | 11/1962 | Hoffmeister | A63B 25/08 267/292 |
| 3,328,028 | A | * | 6/1967 | Williams | A63B 25/08 282/77 |
| D215,552 | S | * | 10/1969 | Rieth | D21/413 |
| 3,628,791 | A | * | 12/1971 | Garcia | 482/51 |
| 3,929,329 | A | * | 12/1975 | Rivera | 482/71 |
| 4,494,662 | A | * | 1/1985 | Clymer | 482/123 |
| 5,087,037 | A | * | 2/1992 | Morrow | A63B 25/08 472/134 |
| 5,102,119 | A | * | 4/1992 | Gerlach | A63B 25/08 482/77 |
| 5,284,458 | A | * | 2/1994 | Perry et al. | 482/49 |
| 5,409,226 | A | * | 4/1995 | Mesko et al. | 273/148 B |
| 5,518,476 | A | * | 5/1996 | McLeon | 482/79 |
| 5,634,870 | A | * | 6/1997 | Wilkinson | 482/30 |
| 5,658,222 | A | * | 8/1997 | Brown | 482/52 |
| 5,713,819 | A | * | 2/1998 | Hsieh | 482/77 |
| 5,820,520 | A | * | 10/1998 | Sieber | 482/34 |
| D400,609 | S | * | 11/1998 | Hsieh | D21/413 |
| 5,980,432 | A | * | 11/1999 | Ahman | 482/77 |
| 6,425,843 | B1 | * | 7/2002 | Storfer et al. | 482/79 |
| 6,796,928 | B1 | * | 9/2004 | Christopher et al. | 482/51 |
| 6,835,168 | B2 | * | 12/2004 | Huang | 482/123 |
| 7,094,183 | B2 | * | 8/2006 | Hsieh | 482/51 |
| 7,156,790 | B2 | * | 1/2007 | Johnsen | 482/146 |
| 7,419,459 | B2 | * | 9/2008 | Van Straaten | 482/70 |
| 7,559,881 | B1 | * | 7/2009 | Roraff | 482/129 |
| 7,645,221 | B1 | * | 1/2010 | Curry | 482/148 |
| 7,648,444 | B2 | * | 1/2010 | Johnson | 482/52 |
| 7,771,327 | B1 | * | 8/2010 | Reams | 482/80 |
| 7,841,973 | B2 | * | 11/2010 | Trancart et al. | 482/131 |
| 7,981,005 | B1 | * | 7/2011 | Tsai | 482/51 |
| 8,029,420 | B1 | * | 10/2011 | Thati | 482/79 |
| 8,317,668 | B2 | * | 11/2012 | Sales et al. | 482/140 |
| 2003/0119638 | A1 | * | 6/2003 | Chan | 482/146 |
| 2005/0164844 | A1 | * | 7/2005 | Johnson | 482/79 |
| 2005/0209055 | A1 | * | 9/2005 | Anders | 482/51 |
| 2006/0052225 | A1 | * | 3/2006 | Stearns | 482/140 |
| 2008/0280741 | A1 | * | 11/2008 | Baek | A63B 22/14 482/146 |
| 2009/0227426 | A1 | * | 9/2009 | Dubar | 482/34 |
| 2010/0234192 | A1 | * | 9/2010 | Oller, Jr. | 482/131 |
| 2010/0234195 | A1 | * | 9/2010 | Koskela | 482/142 |
| 2011/0281693 | A1 | * | 11/2011 | Arstein | 482/57 |
| 2011/0281701 | A1 | * | 11/2011 | Zhang | 482/146 |
| 2012/0184420 | A1 | * | 7/2012 | Hung | 482/139 |
| 2012/0245004 | A1 | * | 9/2012 | Bremer et al. | 482/129 |
| 2013/0045841 | A1 | * | 2/2013 | Chen | 482/71 |

FOREIGN PATENT DOCUMENTS

| | | |
|---|---|---|
| KR | 1020060100018 | 9/2006 |
| KR | 1020110003233 | 1/2011 |
| KR | 1020110056170 | 5/2011 |

* cited by examiner

STRETCHING DEVICE

TECHNICAL FIELD

The present invention relates to a stretching device which has an improved structure so that the user can easily perform stretching exercises of the Achilles tendons, the waist muscles, the thigh muscles and the calf muscles or posture correcting exercises.

BACKGROUND ART

Generally, people who have jobs that are unrelated to physical labor or require working in one place do not sufficiently move their bodies. Particularly, office workers who work at desks or aged people are inactive, generally suffer a weakening the muscles of parts of their bodies, thus making them evade exercise, further reducing physical activity. Such a lack of exercise may induce a variety of adult diseases.

Recently, interest in health has increased, so there is an increase in people who exercise. Thus, it is easy to find people who go to local mountains to hike or go to playgrounds or parks and run. Many people who cannot exercise outdoors or at playgrounds due to living conditions also use different kinds of exercise machines in their homes or local fitness centers. In many households, various kinds of exercise machines such as running machines, bench presses, etc. are being used.

However, such exercise machines are typically expensive and take up much space. Further, it is difficult for the elderly and the infirm to use such exercise machines.

Particularly, among parts of the body, the legs function to support the weight of the body and move the body. Therefore, because weakening of leg muscles reduces the ability to quickly react, mortal injuries may be caused. Particularly, many modern office workers wear shoes with high heels. Such people must sufficiently exercise the leg muscles or stretch them, because the time maintaining the leg muscles in a contracted state is excessively increased. Recently, there is an increase in the aged population. Aged people are typically slow-moving because of muscle weakening. Thus, aged people lack the ability to react to sudden danger, so that the risk of injury is increased. Therefore, a device to enable a user to conveniently and safely perform stretching exercises is required.

In an effort to achieve the above purpose, introduced were stretching devices which can be easily used indoors even by the elderly and the infirm, are comparatively inexpensive, and are provided with an inclined foothold to make it possible to strengthen waist muscles.

In an example, a muscle and joint stretching exercise device, which is made of wood and is configured in such a way that an inclined foothold is installed by means of a support that is disposed on a base plate, was proposed in Korean Utility Model Registration No. 20-0199661 (Publication date: Oct. 2, 2000).

However, in this conventional stretching exercise device, the foothold is supported on a small area of the support on the base plate, so that it is not reliably stable to support the foothold. Further, the structure of the device is complex, because separate front and side partitions are required to install the support. The complex structure increases the production cost.

In another example, a device for stretching the calf muscles and twisting the waist was proposed in Korean Patent Publication No. 10-2006-0100018 (date: Sep. 20, 2006). This conventional device includes an inclined foothold body which is provided on a rotating plate that is rotatably installed on a main body, and an inclination adjustment unit which has a height-adjustment support to adjust the inclination of the foothold body.

However, in this conventional device, the inclined foothold body is installed on the rotating plate. Thus, when a user stands on the inclined foothold body to stretch the waist, calf or thigh muscles, the rotating plate may undesirably rotate. In this case, the elderly and the infirm who are slow in their movements may fall down and be injured.

Particularly, it is required to restrictively rotate the rotating plate, since the elderly and the infirm may lose balance and fall when the rotating plate rotates.

Give this, a stretching device which has an improved structure to enable a user to more reliably and conveniently perform stretching exercises for the leg and waist muscles is required.

DISCLOSURE

Technical Problem

Accordingly, the present invention has been made keeping in mind the above problems of the instability and the complex structure of the conventional stretching devices, and an object of the present invention is to provide a stretching device which has an improved such that an inclined foothold can be used to stretch the Achilles tendons of the ankles and the leg muscles such as well as the thigh muscles, the calf muscles, etc. and limited elastic rotation of a spring can be used to reliably perform stretching exercises of the waist muscles.

Technical Solution

In order to accomplish the above object, the present invention provides a stretching device provided with a foothold unit having an inclined foothold to enable a user who stands on the foothold to perform stretching exercise of muscles such as calf muscles or Achilles tendons, the stretching device including: a foothold unit comprising a base plate provided on a support surface, and an inclined foothold disposed above the base plate at a position spaced apart from the base plate; and a support pole unit disposed in a central portion of the foothold unit such that the user is able to grasp the support pole unit, the support pole unit comprising a lower tubular member fixed at a lower end thereof to the base plate, an upper tubular member disposed in the lower tubular member so as to be adjustable in height, with a handle provided on an upper end of the upper tubular member, and a fastener fastening the upper tubular member to the lower tubular member, wherein the inclined foothold is provided so as to be rotatable with respect to the support pole unit.

The stretching device may further include a spring disposed between the inclined foothold and the base plate in such a way that opposite ends of the spring are respectively coupled to the inclined foothold and the base plate, the spring elastically supporting the inclined foothold upwards and downwards.

The upper tubular member may extend upwards from the lower tubular member that extends upwards between feet of the user who uses the stretching device, the upper tubular member being bent in a direction corresponding to the direction, in which the foothold is inclined upwards, with a handle protruding outwards from opposite sides of an upper end of the upper tubular member, so that the user stretches out his/her arms and grasps the handle.

Advantageous Effects

In a stretching device according to the present invention, a user stands on an inclined foothold 11 such that his/her heels come into contact with an extension 14, and stretches out his/her arms and grasps a handle 36. Then, since the heels of the user are disposed to be inclined downwards, the Achilles tendons and the calf muscles of the user can be stretched. Furthermore, the inclined foothold is elastically moved upwards and downwards by the elastic force of a spring. Thus, the degree of tension of the muscles can be varied, thus further enhancing the stretching exercise effect. In addition, the entirety of the body of the user can be involved in an up-and-down moving exercise. Moreover, because the inclined foothold 11 can rotate to the left and the right with respect to an upper tubular member 32, the user can also conduct the stretching exercise of the waist muscles in such a way that the user grasps the handle and turns his/her body to the left and the right. As such, the stretching device that has a simple structure using the inclined foothold makes it possible for the user to easily perform exercises of the whole body. Particularly, even the elderly and the infirm can easily use the stretching device. As described above, the present invention is very useful despite having a simple structure.

BEST MODE

Hereinafter, an embodiment of a stretching device according to the present invention will be described in detail with reference to the attached drawings.

Figure 1:
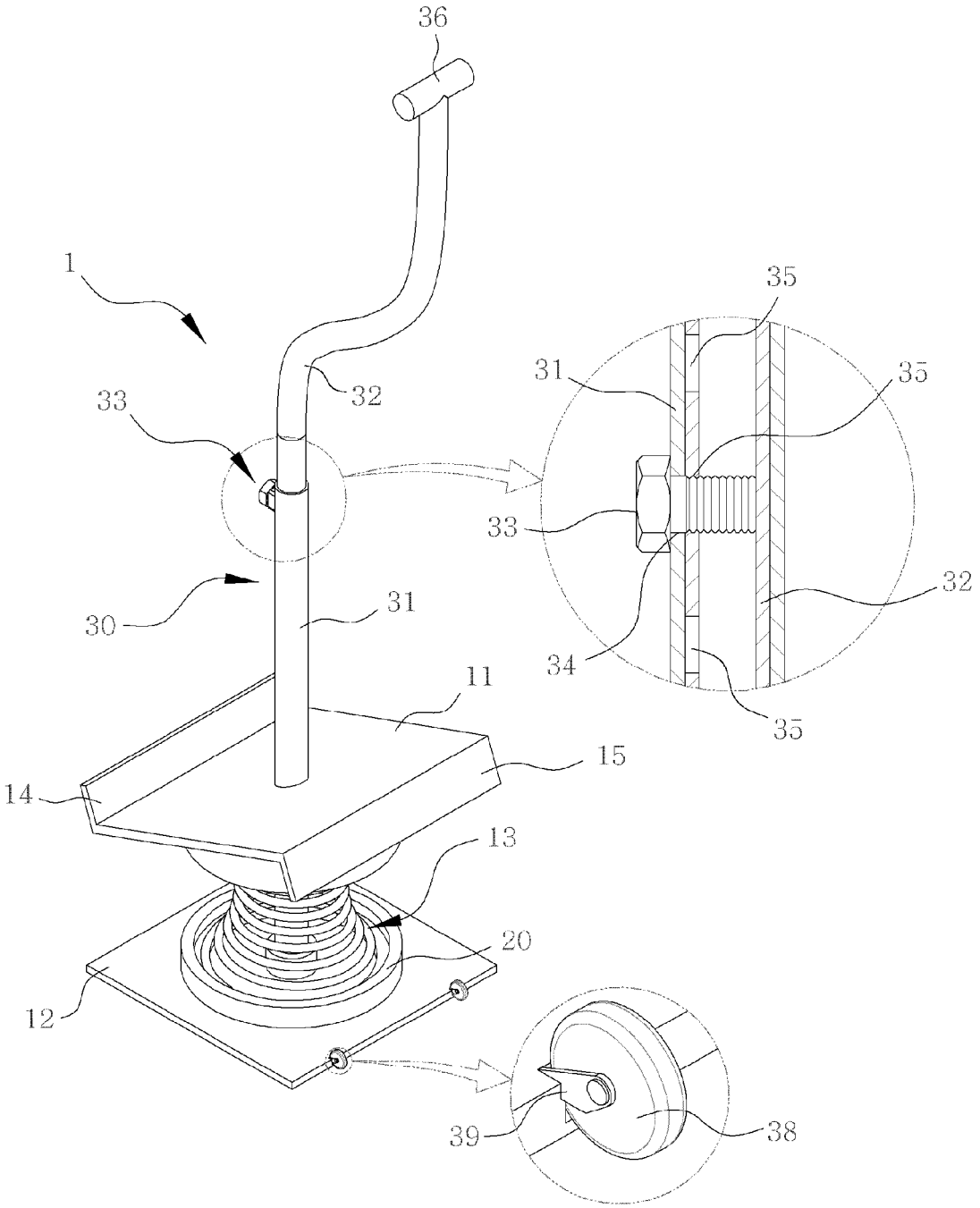
FIG. 1 is a schematic perspective view of a stretching device according to the present invention.
Figure 2:
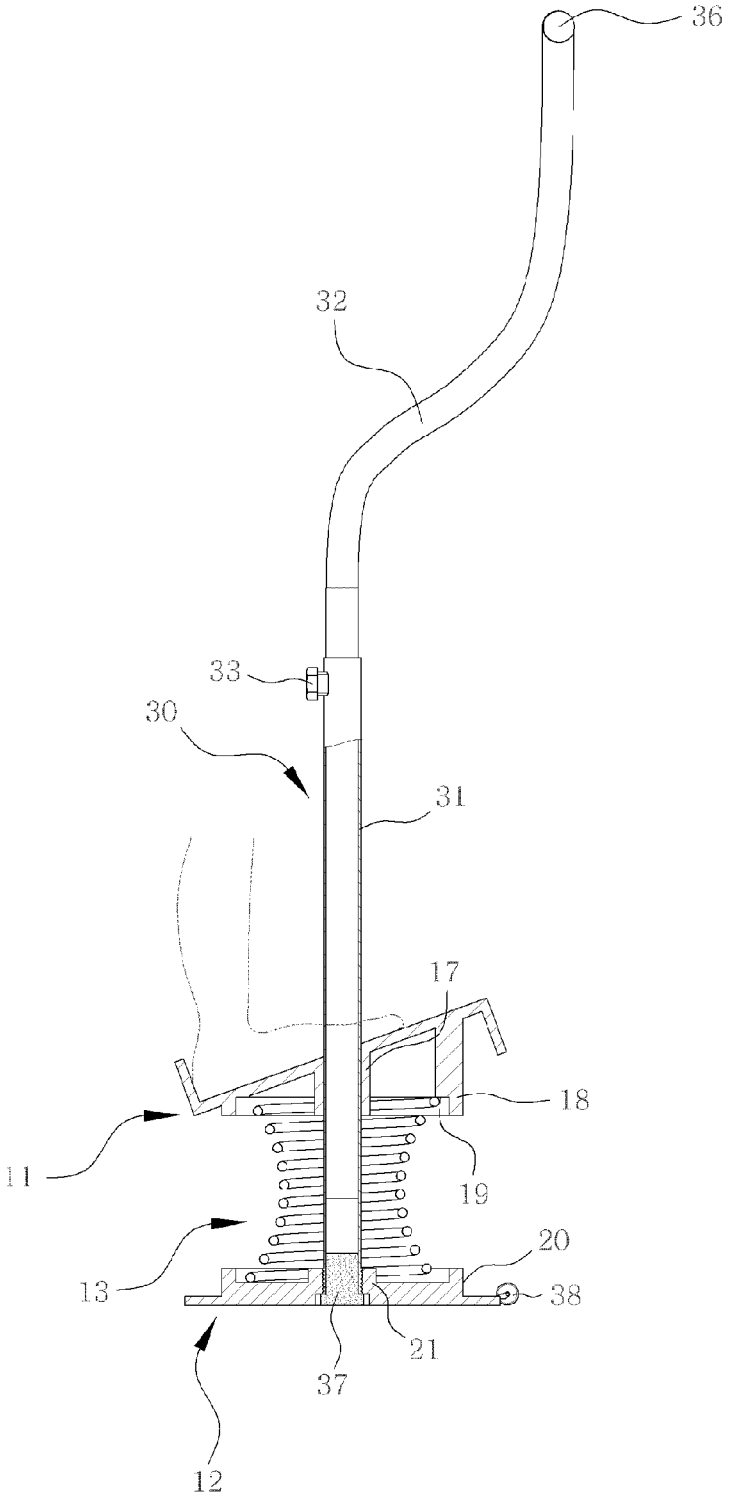
FIG. 2 is a side view of the stretching device of FIG. 1.

As shown in FIGS. 1 and 2, the stretching device 1 according to the present invention includes a foothold unit 10 and a support pole unit 30 which is provided in a central portion of the foothold unit 10 to enable a user to grasp it with his/her hands and keep his/her balance.

The foothold unit 10 includes a rectangular foothold 11 which is disposed to be inclined, a base plate 12 which is provided on the ground, and a spring 13 which is disposed between the inclined foothold 11 and the base plate 12 and opposite ends of which are respectively fixed to the inclined foothold 11 and the base plate 12.

The support pole unit 30 includes a lower tubular member 31 which has a pipe shape and is fixed at a lower end thereof to the base plate 12, an upper tubular member 32 which is inserted into the lower tubular member 31 so as to be adjustable in height, and a fastener 33 which fastens the upper tubular member 32 to the lower tubular member 31. The fastener 33 has a bolt structure provided with a knob and is inserted into a hole 34 which is formed in an upper portion of the lower tubular member 31. The fastener 33 is also inserted into one selected from among a plurality of holes 35 which are formed in the upper tubular member 32 to allow the support pole unit 30 to be adjusted in height in response to the height of a user. The fastener 33 that is inserted into the selected hole 35 of the upper tubular member 32 comes into close contact with an inner surface of the upper tubular member 32 that faces the end of the fastener 33. In this way, the upper tubular member 32 is fastened to the lower tubular member 31 at a desired position.

The lower tubular member 31 extends upright between the feet of the user. Therefore, if the upper tubular member 32 extends collinearly with the lower tubular member 31, not only it is difficult for the user to grasp it but the center of gravity is also biased to a rear portion of the foothold, in other words, the lower end of the inclined foothold, whereby, when in use, the center of gravity of the user may be excessively displaced from the support pole unit 30 outwards. To avoid the above problems, an upper part of the upper tubular member 32 is bent outwards, that is, in a direction corresponding to the direction in which the foothold is inclined upwards. Furthermore, a handle 36 protrudes outwards from both sides of an upper end of the upper tubular member 32 so that, when in use, the user can stretch out his/her arms and grasp the handle 36. Thereby, overall, the center of gravity of the user can is adjacent to the support pole unit to enable the user to keep his/her balance without falling over.

An extension 14 is bent upwards from the lower end of the inclined foothold 11 so as to support the heels of the user. An extension 15 is bent downwards from an upper end of the inclined foothold 11 to enhance the strength of the inclined foothold to resist deformation. Although it is not shown in the drawings, anti-slip grooves or acupressure protrusions may be formed in the upper surface of the inclined foothold 11. A central boss 17 is provided under a lower surface of the inclined foothold 11, and the support pole unit 30 that has a tubular shape can be inserted into the central boss 17. An annular boss 18 is also provided under the lower surface of the inclined foothold 11 around the central boss 17. The inclined foothold 11 is provided so as to be rotatable relative to the support pole unit 30. A stepped portion 19 is formed in the annular boss 18. An upper end of the spring 13 that is disposed between the inclined foothold 12 and the base plate 12 is supported by the stepped portion 19.

An annular boss 20 is provided on an upper surface of the base plate 12. A lower end of the spring 13 is disposed inside the annular boss 20, whereby the spring 13 can be maintained at the correct position thereof. A central boss 21 which has an internal thread on an inner surface thereof is provided on a central portion of the base plate 12. The lower tubular member 31 can be coupled to the base plate 12 in such a way that an external thread formed on the lower end of the lower tubular member 31 engages with the internal thread of the central boss 21. A stopper 37 is fitted into the lower end of the lower tubular member 31.

In the drawings, reference numeral 38 denotes a caster provided to allow the user to easily move the stretching device. The caster 38 is mounted to a bracket 39 which is provided on at least one edge of the base plate 12. Although the caster 38 is illustrated in the drawings as being provided at only one side, another caster may also be provided at the opposite side. Furthermore, the caster 38 is disposed at a position, at which a lower portion thereof comes into light contact with the ground, so as to ensure stability when the user uses the inclined foothold. Of course, the caster 38 must be configured such that the base plate is prevented from being spaced apart from the ground.

The user stands on the inclined foothold 11 such that his/her heels come into contact with the extension 14, and stretches out his/her arms and grasps the handle 36. Then, since the heels of the user are disposed to be inclined downwards, the Achilles tendons and the calf muscles of the user can be stretched.

Furthermore, when the user who stands on the inclined foothold 11 applies force thereto in the vertical direction, the inclined foothold is elastically moved upwards and downwards by the elastic force of the spring 13 provided under the foothold 11. Thereby, the degree of tension of the Achilles tendons and the calf muscles of the user can be varied, thus further enhancing the stretching exercise effect. In addition, by virtue of the elastic vertical movement of the inclined foothold 11, the entirety of the body of the user can be moved upwards and downwards. As a result, the effect of exercise of the whole body can be obtained.

Moreover, the inclined foothold 11 can smoothly rotate to the left and the right with respect to the upper tubular member 32. Thus, the user can also conduct a stretching exercise of the waist muscles in such a way that the user grasps the handle and turns his/her body to the left and the right.

The invention claimed is:

1. A stretching device for performing stretching exercises of muscles including calf muscles and Achilles tendons, the stretching device comprising:

a base plate;

a first tubular support pole, a lower end portion of which is fixed to a center of the base plate;

a foothold including a central boss attached to an underneath thereof, the foothold being slidably and rotatably positioned around the first tubular support pole, the first tubular support pole being positioned through the central boss, wherein the foothold is inclined from a first end portion upwardly to a second end portion of the foothold, and the foothold includes an upright extension formed at the first end portion thereof to support heels of a user;

a spring disposed around the first tubular support pole between the base plate and the foothold;

a second tubular support pole, a lower end portion of which is coupled to an upper end portion of the first tubular support pole in a height adjustable manner, wherein the second tubular support pole includes a bent portion at a lengthwise center portion thereof, which is bent in a direction of the second end portion of the foothold; and a handle fixed to an upper end portion of the second tubular support pole.

2. The stretching device of claim 1, wherein the spring includes a coil spring, a first end portion of which is fixed to the foothold and a second end portion of which is fixed to the base plate such that the coil spring elastically supports the inclined foothold upwards and downwards, and clockwise and counterclockwise.

3. The stretching device of claim 1, wherein the foothold includes anti-slip grooves or acupressure protrusions formed on an upper surface thereof.

4. The stretching device of claim 1, wherein the foothold includes a downright extension formed at the second end portion thereof to enhance strength of the foothold.

5. The stretching device of claim 1, wherein the base plate includes a caster installed at one side portion thereof.

* * * * *